US005375378A

United States Patent [19]

Rooney

[11] Patent Number: 5,375,378

[45] Date of Patent: Dec. 27, 1994

[54] METHOD FOR CLEANING SURFACES WITH AN ABRADING COMPOSITION

[76] Inventor: James J. Rooney, 773302, Houston, Tex. 77215

[21] Appl. No.: 43,188

[22] Filed: Apr. 6, 1993

Related U.S. Application Data

[63] Continuation-in-part of Ser. No. 838,866, Feb. 21, 1992, abandoned.

[51] Int. Cl.[5] ..... B24B 1/00

[52] U.S. Cl. ..... 451/38; 134/22.12; 134/22.18; 134/22.11; 451/36; 451/40

[58] Field of Search ..... 51/410, 427, 428, 439, 51/317, 319, 320, 321; 134/2, 22.12, 22.18, 22.11

[56] References Cited

U.S. PATENT DOCUMENTS 3,870,560 3/1975 Shumaker ..... 134/2
4,216,910 8/1980 Kimbrough ..... 239/456

OTHER PUBLICATIONS

Comprehensive Inorganic Chemistry, J. D. Bailar pp. 1390–1427 Pergamon Press, 1973.
Intro to Separation Science, Wilcox, pp. 303 to 335, 1973.
Kirk-Othmer Encyclopedia of Chemical Technology, Synthetic Inorganic Silicates, 3rd Ed., vol. 20, pp. 855–880, 1982.

*Primary Examiner*—James G. Smith
*Assistant Examiner*—Eileen P. Morgan
*Attorney, Agent, or Firm*—Pravel, Hewitt, Kimball & Krieger

[57] ABSTRACT

This invention relates to a method and devices for hydroblasting wherein a hydrolyzed solution of a silica compound and water, the hydrolyzed solution containing solid particles of the silica compound, is ejected at the surface to be cleaned.

29 Claims, 2 Drawing Sheets

METHOD FOR CLEANING SURFACES WITH AN ABRADING COMPOSITION

This is a continuation-in-part of co-pending application Ser. No. 838,866 filed on Feb. 21, 1992, now abandoned.

BACKGROUND OF THE INVENTION

1. Field of the Invention

The present invention relates to hydroblasting in general. More particularly, the present invention relates to methods of cleaning and cutting surfaces utilizing abrasives mixed with water to form a cutting mixture along with employing nucleation catalytic impact tubes and nucleation blaster tips of various design.

2. Description of the Related Art

A wide variety of methods are used for the cleaning and cutting of various surfaces. In the cleaning and cutting of flat exterior surfaces, it is quite common to utilize sandblasting techniques. Sandblasting causes the ejection of sand particles under high pressure. As the sand particles impinge upon the surface, an abrasive action takes place which results in the cleaning of the surface. Sandblasting is particularly applicable when material accumulation is not a critical factor in the cleaning environment. Sandblasting is not appropriate for the cleaning of pipes, conduits, valves, and other internal surfaces. Also, sandblasting is often not preferred as it may pit a metal surface, leading to a degrading of the metal surface.

Another technique employed for the cleaning of various surfaces is the use of hydroblasting. Hydroblasting is designed for the cleaning of many interior surfaces in which material accumulation can present a problem. For example, hydroblasting is often used for the cleaning of pipes and tubes in oil field equipment, in factory applications, and in other fields of endeavor. Hydroblasting essentially consists of the utilization of a pumping mechanism which causes the pressurized release, through a nozzle, of a stream of water.

Unfortunately, hydroblasters have generally proved to be ineffective in the cleaning of pipes which are clogged with a viscous material. Since a hydroblaster relies upon the rotation of a nozzle and relies upon the high pressure ejection of water, it is common for the hydroblasters to bog down in the viscous material within the pipe. Since the hydroblaster emits one stream for cleaning purposes, the clogging of the hydroblaster prevents the hydroblaster from properly rotating for the thorough cleaning of the interior of the pipe. As the hydroblaster encounters obstructions within the pipe, the high pressure liquid stream emitted from the hydroblaster will only clean in one direction within the pipe. As a result, a great deal of streaking results from the use of hydroblasting.

It has been found that the streaking of pipes is an ineffective solution to the problem of a clogged pipe. Whenever streaking occurs in a pipe, this results in easier and quicker accumulation of the clogging material. In simple terms, the streaking of a tube promotes "addition". Since the use of conventional hydroblasters virtually inherently results in a streaking of the tube surface, hydroblasting is a relatively ineffective solution to clogged tubes and pipes.

In conventional hydroblasting applications, whenever the hydroblaster nozzle became clogged within the pipe, the operators of the hydroblaster simply increase the pressure of the water from the nozzle until it effectively penetrates the viscous material in the pipe. There was no way to maintain the constant rotation of the spinner nozzles. As a result, it has become conventional within the hydroblasting business to rely on pure water force for the cleaning of pipes and other surfaces. The use of high pressure results in increased fuel consumption. It also causes an increased fatigue of the blaster gunner. As increased fatigue is applied to the mechanical components of the hydroblasting operation, there is a greatly increasing chance of an accident. Given the high pressures that are utilized in hydroblasting operations, any metal fatigue or other material deterioration can cause a potentially fatal accident. In order to avoid such fatigue and dangers, hydroblasting companies must greatly increase their costs of maintenance and inspection. Another problem with the use of extremely high pressures for the hydroblasting of surfaces is that higher pressures more frequently result in lower blasting volumes. Thusly, this results in less waste product actually removed from the surface which is blasted.

It is an object of the present invention to provide a cutting mixture that can be used in hydroblasting operations.

Another object of the present invention is to provide a method of cleaning surfaces which effectively prevents clogging and streaking.

It is another object of the present invention to provide a method of cleaning which is environmentally safe.

It is still a further object of the present invention to provide a hydroblasting method of cleaning which reduces the pressures required for effective cleaning.

It is still another object of the present invention to provide a method of cleaning utilizing hydroblasting technology which is easy to use, relatively inexpensive, and effective.

These and other objects and advantages of the present invention will become apparent from a reading of the attached specification and appended claims.

SUMMARY OF THE INVENTION

The present invention relates to a method of cleaning a surface which comprises the steps of: (1) obtaining a hydrolyzed solution of a silica compound and water having solid particles of the silica compound; (2) pumping the hydrolyzed solution to an orifice; and (3) spraying the pumped hydrolyzed solution through the orifice at a pressure greater than 500 p.s.i. to impinge the solid particles of the silica compound on the surface to be cleaned. This method is improved by inducing nucleation to increase the number of more dense solid particles in the mixture.

The present invention further relates to the devices used for cleaning a surface via the method of the present invention. More particularly, the invention relates to nucleation nozzles, nucleation impact tubes and nucleation blaster tips. The nucleation impact tubes induce the formation of more solid particles which increase the abrasive and cutting properties of the hydrolyzed solution. The inventive nozzles and blaster tips provide an effective means to deliver the pumped hydrolyzed solution to the surface to be cleaned.

The present invention provides an improved method of cleaning which is superior to known conventional hydroblasting operations. The present invention also provides the inventive devices useful in carrying out the method of cleaning.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Figure 1:
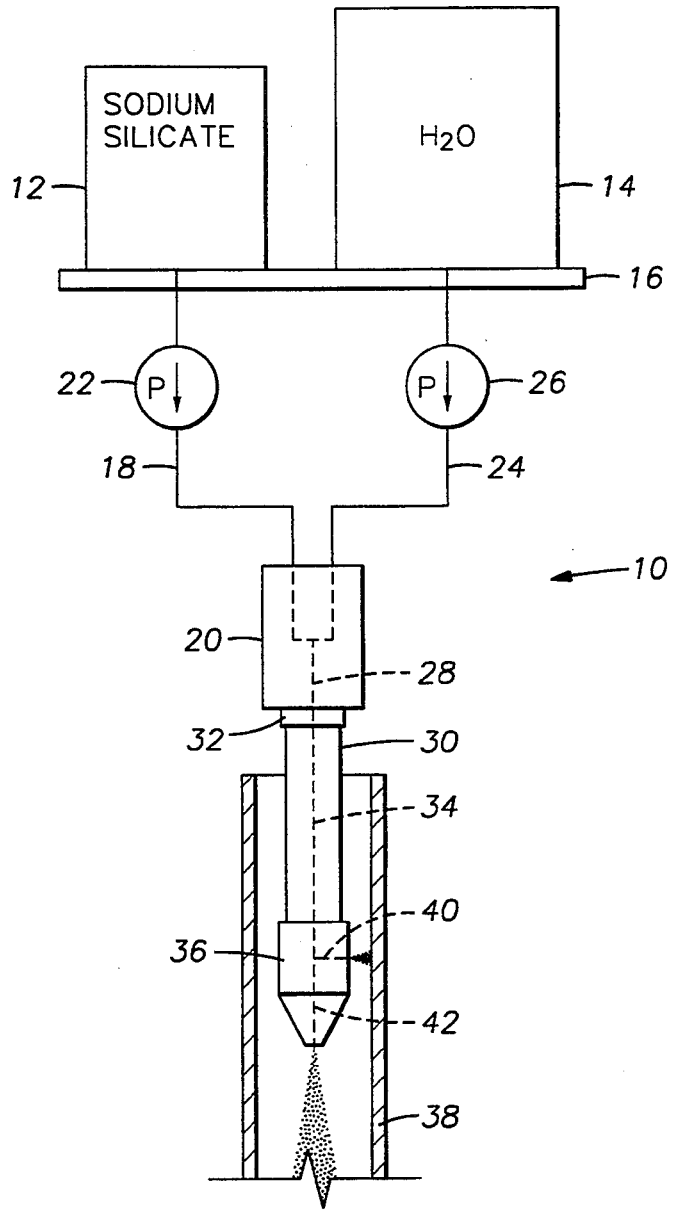
FIG. 1 is a block diagram illustrating the method of the present invention.

The present invention relates to a method of cleaning a surface which comprises the steps of: (1) obtaining a hydrolyzed solution of a silica compound and water having solid particles of the silica compound; (2) pumping the hydrolyzed solution to an orifice; and (3) spraying the pumped hydrolyzed solution through said orifice at a pressure greater than 500 p.s.i. to impinge the solid particles of the silica compound on the surface to be cleaned.

As disclosed herein, a "hydrolyzed solution" of a silica compound and water relates to a solution wherein the silica compound is a water soluble silica compound or wherein the solution has suspended solids therein or wherein the solution is an aqueous slurry.

As disclosed in Kirk-Othmer Encyclopedia of Chemical Technology, Synthetic Inorganic Silicates, 3rd Ed., Vol. 20, p. 855–880, 1982, hereby incorporated by reference, and Comprehensive Inorganic Chemistry, edited by J. D. Bailar, p. 1390–1427, Pergamon Press, 1973, hereby incorporated by reference, the water soluble silica compounds when combined with water form a variety of phases including solid, semi-solid, and gel phases, including solutions containing these phases. This invention is concerned with solutions of water soluble silica compounds and water which have solids (including semi-solids and gels) contained therein. These solids may exist in a variety of structures including crystalline and polymer. The water soluble silica compounds with which this invention is primarily concerned with are sodium silicate and potassium silicate. Commercially available soluble silicates, and in particular sodium silicates, may exist in many forms including anhydrous glasses, hydrated amorphous powders, solutions (including waterglass), and crystalline solids (including sodium orthosilicate, anhydrous sodium metasilicate, sodium metasilicate pentahydrate and sodium sesquisilicate). Regardless of form, the aforementioned soluble silicates may be used as the starting materials in the process of the present invention. The preferable soluble silicates are commercially available sodium silicate solutions of 40°–42° Baumé and sodium silicate crystalline solids.

As disclosed in an Introduction to Separation Science, Crystallization, by W. R. Wilcox, p. 303–335, edited by Barry L. Karger and Lloyd R. Snyder, published by John Wiley & Sons, 1973, hereby incorporated by reference, "nucleation" relates to the forming of the nucleus of a crystal structure. The nucleus of a crystal is defined as a certain critical size, sufficiently large to overcome the influence of surface energy, wherein the crystal grows spontaneously by the addition of molecules from the solution. As disclosed herein, "nucleation" also refers to the forming of additional polymeric structures, including the fracturing of larger polymers into smaller polymers.

As disclosed in the reference, Introduction to Separation Science, noted above, nucleation may be induced by providing a supersaturated or supercooled solution. Further, nucleation may be induced or increased (1) mechanically (dynamic nucleation) by friction; (2) by high-speed fluid motion; (3) by cavation; (4) by seed crystals; (5) by crystal breeding or secondary nucleation; (6) by crystal fracture into pieces by collision, known as collision or attrition breeding; and (7) by contact nucleation. It is believed that the method of the present invention may be improved by increasing the number of solid particles, including crystalline structures and polymer structures, in the hydrolyzed solution to be sprayed at the surface to be cleaned or cut as to which tip or nozzle is to be used for the project. Thus, as discussed below, various steps and devices have been included to increase nucleation, i.e., to increase the number of nuclei and crystalline structures and polymer structures formed. In the method of the present invention, it is believed preferable to have hard, dense solid particles.

The abrasive and cutting effect achieved by the method of the present invention is believed to be attributed to the impingement of solid particles, including nuclei and crystalline structures and polymer structures, contained in the sprayed hydrolyzed solution upon the surface to be cleaned. Thus, increasing the number of solid particles, i.e., nuclei and crystalline structures and polymer structures, is believed to increase the cleaning efficiency of the present method.

Further, it was determined that the addition of fumed silica also improves the efficiency of the present cleaning method. Fumed silica is finely divided silica obtained by the reaction of silicon tetrachloride ($SiCl_4$) and hydrogen ($H_2$). While the mechanism by which fumed silica improves the present process is not fully understood, it is believed that fumed silica serves to seed or breed crystals. A mixture of fumed silica and water will form an aqueous suspended slurry and is included in the herein used definition "hydrolyzed solution".

Referring to FIG. 1, there is shown at 10 the process of the present invention for the cleaning of surfaces. The process 10 has a supply of a hydrolyzed solution of a silica compound and water, the mixture containing solid particles of the silica compound (referred to as "sodium silicate") 12 and a quantity of water 14. The sodium silicate 12 and the water 14 can be contained within tanks supported on platform 16. In mobile applications, the tank of sodium silicate 12 and the tank of water 14 can be placed on the back of a truck or trailer for transportation to a desired location.

In the broad concept of the present invention, the preferred choice of the silica compound depends upon the surface to be cleaned. As shown in the Examples below, depending upon the surface to be cleaned, the preferred silica compounds are: 40°–42° Baumé sodium silicate solutions, sodium silicate crystalline solids, and- /or fumed silica. While just a hydrolyzed solution of 40°–42° Baumé sodium silicate solution and water will perform satisfactorily in some cases, it is not as preferred as the other embodiments as shown in the Examples. Also, while just the hydrolyzed solution of the silica compound and water will perform satisfactorily, it is preferable to neutralize the solution to a pH of approximately 7.0–7.5. Neutralization achieves several objectives. First, it is believed to aid in the formation of additional solid particles. Also, it reduces the concerns of otherwise high alkalinity hydrolyzed solutions damaging the equipment to be cleaned. For example, high alkalinity may increase the leaching of nickel from stainless steel and the lignins/tannins from cooling tower wood. It will also attack the bronze and brass in the towers. It is preferable to utilize a volatile acid in this neutralization as a volatile acid will simply evaporate if inadvertently spilled or otherwise dispersed. Also, it is preferable to use easily available, readily trusted, weak acids such as 5% acetic acid or 5% citric acid.

Additionally, potassium silicate could be used in combination with or in substitute for sodium silicate. Potassium silicate ionizes quickly and is generally more soluble in water than is the 40° or 42° Baumé sodium silicate solution. Potassium silicate can also be mixed with the sodium silicate. On the other hand, the use of potassium silicate is not the "preferred" embodiment of the present invention since the potassium silicate is generally much more expensive than is sodium silicate.

Referring to FIG. 1, the sodium silicate 12 passes by line 18 to an inlet of distributor 20. A booster pump 22 is provided along line 18 so as to properly deliver the sodium silicate 12 to the distributor 20. The water 14 passes along line 24 to another inlet of distributor 20. A pump 26 is provided so as to deliver a sufficient volume of water 14 to the distributor 20. In the block diagram of FIG. 1, it can be seen that the lines 18 and 24 are joined within the distributor block 20. In essence, the distributor 20 provides the mixing of the sodium silicate 12 with the water 14.

The ratio of the sodium silicate 12 to water 14 is controlled by the concentration of sodium silicate in the solution 12 and is controlled by the volume of water 14 which is pumped in relation to the sodium silicate 12. Experimentation has shown that various ratios of sodium silicate 12 to water 14 can be used within the concept of the present invention. Depending on the particular application to which the present invention is used, the ratio of sodium silicate 12 to water 14 can be one part sodium silicate 12 with between one part and four million parts of water 14. The cleaning ability of the present invention is in relation to the proportion of sodium silicate 12 to water 14. As such, if it is necessary to apply strong abrasive and/or cutting forces to a surface, then a greater concentration of sodium silicate 12 is required. Stronger abrasive and cutting forces can also be achieved through additional pressure from the pumps. On the other hand, if the material to be cleaned is not very viscous, then much lower concentrations and lower pump pressures can be utilized. The degree of concentration is also a function of the cost requirements for a particular job. It is necessarily true that the cleaning solutions having a greater concentration of sodium silicate 12 will be more expensive than a cleaning solution with less sodium silicate 12.

Referring to FIG. 1, a nucleation catalytic impact tube 30 (see FIGS. 4 and 4A) and tip member 36 (see FIGS. 2, 3, 3A and 3B) is affixed at 32 to an outlet 28 of distributor 20. Nucleation catalytic impact tube 30 is fastened to the distributor 28. The nucleation catalytic impact tube 30 serves to speed (catalyze) the formation of solid particles, including nuclei and crystalline structures and polymer structures, and allows the hydrolyzed solution to pass along line 34 toward tip member 36. It can be seen that the tip member 36 may be placed within a pipe 38 for cleaning purposes. As discussed in more detail below, tip member 36 may be either a rotating nozzle or nucleation blast tip, or it may be a rotating nozzle preceded with a nucleation tube. FIG. 1 generally shows a nozzle which has a first line 40 which extends perpendicular to line 34 and allows for the hydrolyzed solution to pass in a radial direction. Passageway 42 allows for the hydrolyzed solution to pass outwardly from the end of the tip member 36. As can be seen, the spray emitted from the orifice 40 serves to clean the sides of pipe 38. The fluid ejected from the orifice 42 serves to clean the forward pathway of the tip member.

In conventional cleaning applications, tip member 36 will be inserted into a pipe. The cleaning action caused by the ejection of the sodium silicate 12/water 14 hydrolyzed solution cleans both the interior walls of pipe 38 and also cleans the pathway for the tip member 36 as it moves through pipe 38. Orifice 40 may cause the ejection of a fluid in a direction angularly rearwardly of tip member 36. This thrust effect provides the necessary force so as to cause the tip member 36 to move within the pipe 38. The ejection of fluid through orifice 42 causes a digging and dispersal action for any material which may be blocking the pipe 38 forward of the tip member 36. The side-rearward ejection of fluids also produces a flushing action for any of the material broken up forward of tip member 36.

The sodium silicate 12/water 14 hydrolyzed solution is fed continuously through tip member 36. This hydrolyzed solution is used to achieve an abrasive and/or cutting effect with hydroblasting operations. The sodium silicate 12/water 14 hydrolyzed solution has been tested up to 75,000 p.s.i. It has been found that the hydrolyzed solution of sodium silicate 12/water 14 is able to thoroughly and uniformly clean and remove deposits from surfaces.

It is generally preferred that the sodium silicate 12/water 14 hydrolyzed solution be fed continuously to the tip member 36 so as to maintain rotational speed if a nozzle is being used. Continuous feed also helps prevent clogging and uneven cleaning. The thorough cleaning of pipes not only prevents additional build-up on pipes, but it also prevents or greatly retards leaching where chlorine comes into contact with stainless steel and otherwise leaches the nickel out of the stainless steel. The sodium silicate 12/water hydrolyzed solution is easily fed with air-driven positive displacement, i.e., piston pumps. Due to the abrasive nature of the hydrolyzed solution, pump seals remain effective only for a limited period, and generally, two pumps are used to spare each other and to allow continuous operation while one pump is having its seals replaced.

When tip member 36 is a spinner nozzle, the sodium silicate 12/water hydrolyzed solution helps to prevent the self-purging spinner head nozzle from clogging. As was stated previously, such clogging would either stop the nozzle or greatly reduce its cleaning capacity. The sodium silicate 12/water hydrolyzed solution causes the forming of a molecular film for cleaning out pits of galvanic and leaching action. As a result, it serves to extend the life of the cleaned equipment. By extending the life of the cleaned equipment, the present invention reduces lost production time and saves man hours and maintenance. The sodium silicate 12 will, in most cases, encapsulate or gravitationally ground out volatile toxic material ejected into the atmosphere during the cleaning by the action of adherence or molecular film coating. As a result, the present invention provides environmental advantages.

The present process may be employed for cleaning a variety of surfaces including metal, glass and wood. It has been used successfully clean flat surfaces as well as the inside surfaces of tubes and heat exchangers. The present process is particularly suitable for cleaning polymers, such as polyethylene, from heat exchanger tubes employed in the process of making the polymer. This present process has been much more successful than the known hydroblasting techniques which form "tube rupture voids", thus seriously damaging the heat exchangers, when 10,000 to 45,000 psi pressure is employed to clean the clogged tube.

The sodium silicate 12/water hydrolyzed solution can easily be washed out with a water hose of standard pressure. The most practical and time efficient way is to close the valve for the sodium silicate 12 solution so that the operator can continue blasting with just water. This flushes any sodium silicate 12 remaining within the tip member 36 or the other elements of the cleaning system of the present invention.

As previously noted, tip member 36 may comprise a spinner nozzle, a nucleation blast tip, or a combination of the two. Generally, a spinner nozzle projects rotating streams which clean a 360° area. A nucleation blast tip, on the other hand, serves to provide a means for spraying the hydrolyzed solution through one or more orifices, while at the same time, serving to induce or increase nucleation. Spinner nozzles may also include features designed to further advance nucleation.

Figure 2:
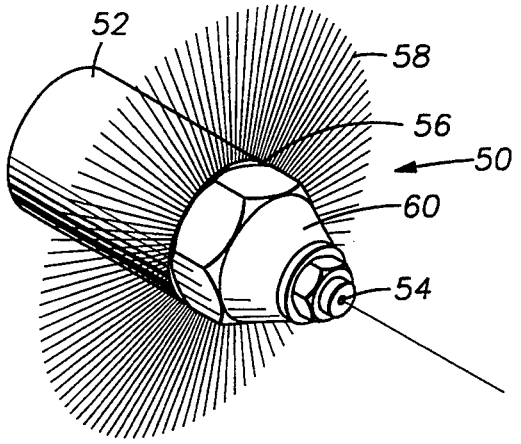
FIG. 2 is a perspective view showing a nozzle used by the method of the present invention.

FIG. 2 illustrates at 50 a spinning nozzle of the present invention. It can be seen that the nozzle 50 has a body 52, having a first orifice 54 formed on the forward end of body 52 and an orifice 56 formed on the side of body 52. The spray lines 58 emanate from rotary barrel 60 and show the pattern of spray throughout the rotation of the nozzle 50. The body 52 can be connected to the nucleation catalytic impact tube 30 (see FIG. 1) in a conventional fashion. It can be seen that the spray lines 58 illustrate how the liquid is ejected sideways and rearwardly of the head 60 of the nozzle 50.

Various nozzles can be used with the sodium silicate 12/water hydrolyzed solution of the present invention. For example, the nozzle shown in FIG. 2 may be fitted with a changeable rotary barrel 60 to make it adaptable for various liquid quantities during cleaning operations. The self-purging spinning nozzle has the necessary tolerances to meet the requirements quantitatively and qualitatively so as to keep the nozzle from bogging down. In the nozzle as shown in FIG. 2, if by chance the nozzle should become clogged by a foreign particle, then the nozzle 50 can be readily removed so that the foreign particle or substance can be removed. The nozzle 50 is conventionally made of carpenters 20 stainless steel. The rotary barrel 60 is made up of different materials depending upon the materials to be cleaned and the conditions present.

Figure 2A:
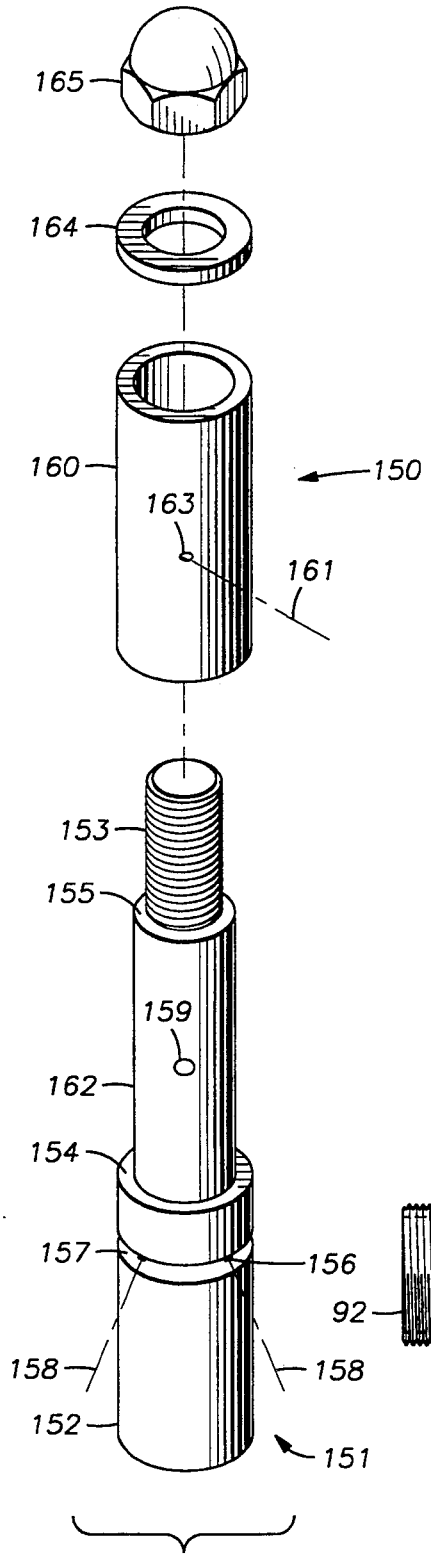
FIG. 2A is an exploded view of an alternate embodiment of a nozzle.

An alternate embodiment of a spinner nozzle is shown in FIG. 2A. Here, the spinner nozzle 150 comprises a hollow body 151 having a male connection 153 at the distal end thereof, a sleeve 162 having a first ledge 154 and a second ledge 155 located proximal thereto, and a thickened base portion 152. The thickened base portion 152 includes a circumferential groove 157 with downwardly projecting pusher jet holes 156 which emit a spray of hydrolyzed solution as shown by spray lines 158. Rotary barrel 160 fits over sleeve 162 and barrel 160 rests on ledge 154. Retainer ring 164 fits over male connection 153 and rests on ledge 155. Retainer nut 165 mates with male connection 153 and secures the rotary barrel 160 and retainer ring 164 to body 151.

In use, the sodium silicate/water hydrolyzed solution moves upwardly (positioned as shown) through the hollow body 151. A portion of the hydrolyzed solution exits through pusher jet holes 156 while the remainder exits the body 151 cavity at port 159. The spray emitted from pusher jet holes 156 serves several functions. First, due to a thrust effect, it serves to advance the nozzle 150 within the pipe. Also, it serves to cut material from the pipe walls and clean the walls. Further, it serves to push removed material out of the pipe.

The remaining portion of the hydrolyzed solution which exits port 159 either travels through barrel spin jet holes 163 or travels upwardly and downwardly along sleeve 162 in the annular space between sleeve 162 and rotary barrel 160, exiting in the space between the bottom of barrel 160 and ledge 154 and the space between the top of barrel 160 and retainer ring 164.

The hydrolyzed solution which exits barrel spin jet holes 163 serves several functions. First, holes 163 are angled such that they project the spray toward the side in a tangential direction as depicted by spray line 161. This serves as side thrusters, causing barrel 160 to spin. The hydrolyzed solution sprayed from holes 163 on spinning barrel 160 cleans a 360° area around the nozzle 150.

The hydrolyzed solution which flows upwardly and downwardly along sleeve 162 forms a lubricating molecular thickness between spinning barrel 160 and sleeve 162, between barrel 160 and ledge 154, and between barrel 160 and retainer ring 164. The barrel 160 has no destructible soft metal or plastic bearings nor seals that abrasives will cut like the conventional nozzles have. This effectively provides "liquid bearings" for rotating barrel 160. This lubricating molecular thickness serves to maintain the rotational speed of barrel 160. This also serves to prevent the barrel 160 from becoming bogged down in highly viscous material. Further, this stream serves to push any foreign material out of the nozzle which would detract from the nozzle's performance. The solution of the present invention provides lubrication and sealing which eliminates the necessity of soft metal and plastic seals that fail in known nozzles when abrasive solutions are used.

Figure 3:
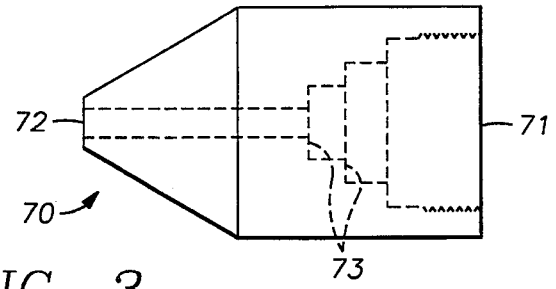
FIG. 3 is a view of a nucleation blast tip.

The tip member 36 (see FIG. 1) may be designed as a "nucleation blast tip" in that it has a significant function of inducing or increasing nucleation. One embodiment of a nucleation blast tip is shown in FIG. 3. The sodium silicate/water hydrolyzed solution enters nucleation blast tip 70 at inlet 71. A series of circular stepped impact plains 73 are located between inlet 71 and outlet orifice 72 and serve to induce or increase nucleation by crystal fracture or contact nucleation.

Figure 3A:
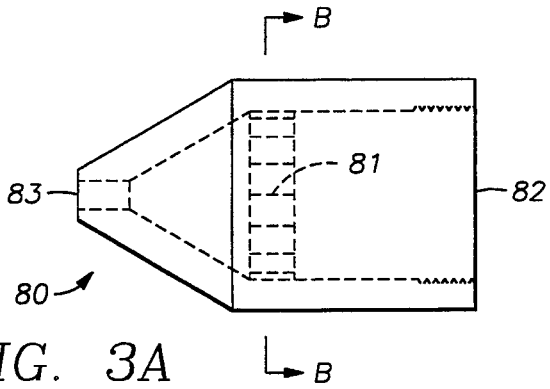
FIG. 3A is an alternate embodiment of a nucleation blast tip.
Figure 3B:
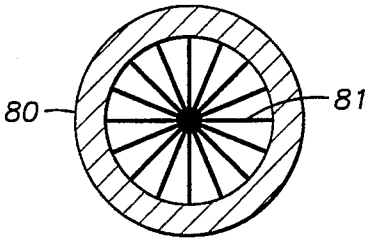
FIG. 3B is a top view taken in the direction indicated by lines B—B of FIG. 3A.

FIGS. 3A and 3B show another embodiment of a nucleation blast tip 80 having impact fins 81 located between the inlet 82 and outlet 83. The impact fins 81 serve to induce or increase nucleation, e.g., by crystal fracture or contact nucleation. The impact fins 81 are shown in cross-sectional view in FIG. 3B. As shown, impact fins 81 consist of multiple planar projections (individual fins) extending radially outward from the axis of the blast tip 80. As shown, the plane of the individual fins lies in the direction of flow, however, this alignment may be deviated from as required to meet the needs of individual cleaning situations. The impact fins 81 may be constructed of any suitable material, e.g., metal or tempered glass. Based on limited experimentation, impact fins 81 constructed of tempered glass increased nucleation more than similar metal impact fins 81.

"Nucleation means" and "means for nucleation" refers to a variety of ways to cause the fluid to impinge upon a surface, or increase turbulence of the fluid, or change direction of the fluid to cause nucleation as previously discussed, e.g., by crystal fracture or contact nucleation. The attached figures show two "means for nucleation". FIG. 3 shows the stepped impact plains 73 and FIGS. 3A, 3B, 4 and 4A show impact fins 81, 93.

Additionally, tip members may have components of both rotating nozzles and nucleation blast tips thus providing increased nucleation while providing a rotating stream that will clean a 360° area.

Many other types of nozzles can also be used with the sodium silicate/water combination of the present invention. For example, under certain circumstances, it may only be necessary to use a nozzle having a forward ejection orifice 54 (see FIG. 2). Alternatively, nozzles can be utilized having only transverse orifices 56. As such, the present invention is suitable for use in a wide variety of applications.

Figure 4:
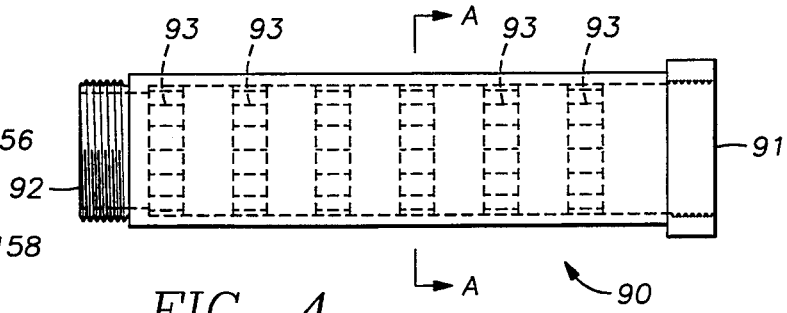
FIG. 4 is a view of a nucleation impact tube.
Figure 4A:
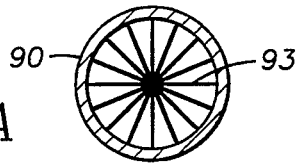
FIG. 4A is a side view taken in the direction indicated by lines A—A of FIG. 4.

FIGS. 4 and 4A illustrate a nucleation catalytic impact tube 90 of the present invention. The nucleation impact tube 90 serves to speed (catalyze) the formation of nuclei and crystallic structures such that upon spraying, an increased number of solid particles will impinge upon the surface to be cleaned. As shown, nucleation impact tube 90 comprises a hollow cylindrical tube having an inlet 91 designed to mate with distributor 20 (see FIG. 1) and an outlet 92 designed to receive a tip member such as a spinner nozzle or nucleation blast tip. Located between the inlet 91 and outlet 92 are a series of impact fins 93, similar in design to impact fins 81 of FIGS. 3A and 3B.

The impact fins 93 are shown in cross-sectional view in FIG. 4A. As shown, impact fins 93 consist of multiple planar projections (individual fins) extending radially outward from the axis of the nucleation impact tube 90. As shown, the plane of the individual fins lies in the direction of flow, however, this alignment may be deviated from as required to meet the needs of individual cleaning situations. The impact fins 93 may be constructed of any suitable material, e.g., metal or tempered glass. Based on limited experimentation, impact fins 93 constructed of tempered glass increased nucleation more than similar metal impact fins 93. It is believed that the impact fins 93 included in the nucleation impact tube 90 increase nucleation via various means, including crystal fracture and contact nucleation.

The sodium silicate/water combination of the present invention provides a superior method of abrading and cutting. There is no oxidation release from its impact cutting. As a result, there is no potential for fire.

It is often necessary to clean the pipe 38 after the present invention has been utilized. In order to assure that no sodium silicate residue remains after cleaning, it is possible to utilize a spinning nozzle so as to provide distilled water under pressure within the pipe 38. After such cleaning procedures, the maximum residue that is left should only be of a molecular thickness.

EXAMPLE 1

Mixture (A): The following were added to 30 gal. of water and mixed:

1. Fumed silica in the amount of approximately 0.5 vol. % to 3.0 vol. % of the water used.
2. Approximately 1.0 to 1.5 gal. of 40° to 42° sodium silicate solution.
3. 5% Acetic acid or 5% citric acid was added as required to lower the pH of the combined solution to approximately 7.0 to 7.5.

Mixture (A) performed well for the cutting of hardened plastics lodged on fragile metal surfaces. Since it is less dense than other sodium silicate/water hydrolyzed solutions used, it has less of a tendency to damage aluminum cooling fins. Also, because the sodium concentration is less than other sodium silicate/water hydrolyzed solutions used, it has less of a tendency to react with aluminum.

EXAMPLE 2

Mixture (B): The following were added to 30 gallons of water and mixed:

1. Fumed silica in the amount of approximately 20–25 vol. % of the water used.
2. Approximately 1.0 to 1.5 gal. of 40° to 42° sodium silicate solution.
3. 5% Acetic acid or 5% citric acid was added as required to lower the pH of the combined solution to approximately 7.0 to 7.5.

Mixture (B) performed well for the cutting of hardened plastics lodged on glass reactors. It is believed that a higher ratio of fumed silica to sodium silicate is less likely to cut glass while cleaning it under high pressure.

EXAMPLE 3

Mixture (C): The following were added to 30 gallons of water and mixed:

1. Solid sodium silicate (crystalline solids —NA2O—$SiO_2$, $NASiO_3$ and $NASiO_4$) in the amount of approximately 1.0–5.0 wt. % of the water used.
2. Approximately 2 to 3 gal. of 40° to 42° sodium silicate solution.
3. 5% Acetic acid or 5% citric acid was added as required to lower the pH of the combined solution to approximately 7.0 to 7.3.

Mixture (C) performed well for the cutting of hardened plastic and other materials off steel or stainless steel. Because mixture (C) has a pH of almost 7 and no chlorine, it is ideal for stainless steel as it will not leach the nickel out of the stainless steel.

EXAMPLE 4

Mixture (D): The following were added to 30 gallons of water and mixed:

1. Fumed silica in the amount of approximately 10 vol. % of the water used.
2. 5% Acetic acid or 5% citric acid was added as required to lower the pH of the combined solution to approximately 7.0 to 7.3.

Mixture (D) performed well for cutting and cleaning stainless, aluminum and copper heat exchangers plugged with plastics. Currently, heat exchangers, valued at over a million dollars, now cleaned and unplugged without the inventive process are now experiencing "tube rupture voids" when 10,000 to 45,000 psi pressure is employed to clear the clogged tubes, thus resulting in heat exchanger destruction in the millions of dollars. For removing polymers accompanied with heavy metals, conventional hydroblasting has been a total failure, e.g., at DuPont in Orange, Tex. several companies have attempted to remove polymer deposits but without success. However, the methods and devices of the present invention have been successful at removing these polymer deposits. Mixture (D) is preferred as these exchangers are sensitive to high alkalinity. Also, since mixture (D) has a pH <7.5, it is preferred for cleaning cooling towers since the low alkalinity will not leach out the lignins or tannins in the cooling tower wood. Also, mixture (D) allows cooling towers to be cleaned with lower pressures which reduces the potential damage and dismemberment to the wood structures.

The present invention provides significant improvements over known hydroblasting techniques such as improved ability to cut and remove material from a surface, improved ability to operate within a viscous medium, and reduced tendency to plug.

Having described the invention above, various modifications of the techniques, procedures, material and equipment will be apparent to those skilled in the art. It is intended that all such variations within the scope and spirit of the invention be included within the scope of the appended claims.

What is claimed is:

1. A method of cleaning a surface comprising the steps of:

obtaining a hydrolyzed solution of a silica compound and water, said hydrolyzed solution containing solid particles of the silica compound;

pumping the hydrolyzed solution to an orifice; and spraying the pumped hydrolyzed solution through said orifice at a pressure greater than 500 p.s.i. to impinge the solid particles of the silica compound on the surface to be cleaned.

2. The method of claim 1, further comprising the step of inducing nucleation of the hydrolyzed solution to increase the number of solid particles in the hydrolyzed solution.

3. The method of claim 2, where the step of inducing nucleation comprises passing the pumped hydrolyzed solution through a tubular member having impact fins.

4. The method of claim 2, further comprising the step of adding an amount of acid sufficient to lower the pH of the hydrolyzed solution to approximately 7.0 to 7.5 prior to pumping the hydrolyzed solution through the orifice.

5. The method of claim 1, wherein the silica compound is selected from the group consisting of sodium silicate, potassium silicate and fumed silica.

6. The method of claim 1, further comprising the step of adding an amount of acid sufficient to lower the pH of the hydrolyzed solution to approximately 7.0 to 7.5 prior to pumping the hydrolyzed solution through the orifice.

7. The method of claim 6, wherein the acid is a volatile acid.

8. The method of claim 6, wherein the acid is selected from the group consisting of acetic acid and citric acid.

9. The method of claim 6, wherein the hydrolyzed solution is obtained by adding to a quantity of water approximately 0.5 to 3.0 vol. % fumed silica and approximately 3 to 5 vol. % of a sodium silicate solution of approximately 40° to 42° Baumé.

10. The method of claim 6, wherein the hydrolyzed solution is obtained by adding to a quantity of water approximately 20 to 25 vol. % fumed silica and approximately 3 to 5 vol. % of a sodium silicate solution of approximately 40° to 42° Baumé.

11. The method of claim 6, wherein the hydrolyzed solution is obtained by adding to a quantity of water approximately 1 to 5 wt. % solid sodium silicate crystals and approximately 6 to 10 vol. % of a sodium silicate solution of approximately 40° to 42° Baumé.

12. The method of claim 6, wherein the hydrolyzed solution is obtained by adding to a quantity of water approximately 10 vol. % fumed silica.

13. The method of claim 1, wherein the surface to be cleaned is an inside surface of a pipe or tube.

14. The method of claim 1, wherein the solid particles are a gel.

15. A method of cutting a deposit from a surface comprising the steps of:

obtaining a hydrolyzed solution of a silica compound and water, said hydrolyzed solution containing solid particles of the silica compound;

pumping the hydrolyzed solution through a tubular member, said tubular member having means for nucleation;

ejecting the pumped hydrolyzed solution through an orifice toward said surface, the ejected hydrolyzed solution having a pressure greater than 500 p.s.i.; and impinging said solid particles of the silica compound onto the surface to remove the deposit.

16. The method of claim 15, wherein the means for nucleation comprises impact fins.

17. The method of claim 15, wherein the means for nucleation comprises stepped impact planes.

18. The method of claim 15, wherein the silica compound is selected from the group consisting of sodium silicate, potassium silicate and fumed silica.

19. The method of claim 15, further comprising the step of adding an amount of acid sufficient to lower the pH of the hydrolyzed solution to approximately 7.0 to 7.5 prior to pumping the hydrolyzed solution through the orifice.

20. The method of claim 19, wherein the acid is a volatile acid.

21. The method of claim 20, wherein the acid is selected from the group consisting of acetic acid and citric acid.

22. The method of claim 19, wherein the hydrolyzed solution is obtained by adding to a quantity of water approximately 0.5 to 3.0 vol. % fumed silica and approximately 3 to 5 vol. % of a sodium silicate solution of approximately 40° to 42° Baumé.

23. The method of claim 19, wherein the hydrolyzed solution is obtained by adding to a quantity of water approximately 20 to 25 vol. % fumed silica and approximately 3 to 5 vol. % of a sodium silicate solution of approximately 40° to 42° Baumé.

24. The method of claim 19, wherein the hydrolyzed solution is obtained by adding to a quantity of water approximately 1 to 5 wt. % solid sodium silicate crystals and approximately 6 to 10 vol. % of a sodium silicate solution of approximately 40° to 42° Baumé.

25. The method of claim 19, wherein the hydrolyzed solution is obtained by adding to a quantity of water approximately 10 vol. % fumed silica.

26. The method of claim 15, wherein the solid particles are a gel.

27. In a hydroblasting method for ejecting a fluid to clean a surface, the improvement comprising using as the fluid a hydrolyzed solution of a silica compound and water, the hydrolyzed solution containing solid particles of the silica compound; and further employing a nucleation means to increase the number of the solid particles.

28. The hydroblasting method of claim 27, wherein the nucleation means comprises a tubular member having impact fins.

29. The hydroblasting method of claim 27, wherein the silica compound is selected from the group consisting of sodium silicate, potassium silicate and fumed silica.

* * * * *